United States Patent [19]

Kondo et al.

[11] 4,383,153

[45] May 10, 1983

[54] LOCKING TYPE PUSH-BUTTON SWITCH

[75] Inventors: Shiro Kondo; Masao Kumagai, both of Furukawa, Japan

[73] Assignee: Alps Electric Co., Ltd., Tokyo, Japan

[21] Appl. No.: 275,659

[22] Filed: Jun. 22, 1981

[30] Foreign Application Priority Data

Jun. 24, 1980 [JP] Japan ..... 55-88366[U]

[51] Int. Cl.[3] ..... H01H 13/56

[52] U.S. Cl. ..... 200/153 J; 200/328

[58] Field of Search ..... 200/153 J, 328

[56] References Cited

U.S. PATENT DOCUMENTS

| | | | |
|---|---|---|---|
| 3,639,714 | 2/1972 | Fujimoto et al. | 200/153 J |
| 3,732,386 | 5/1973 | Ohkita | 200/153 J |
| 3,914,570 | 10/1975 | Lockard | 200/153 J |
| 4,013,855 | 3/1977 | Reichen et al. | 200/153 J X |
| 4,218,598 | 8/1980 | Iwasaki et al. | 200/153 J |

*Primary Examiner*—John W. Shepperd
*Assistant Examiner*—Renee Kidorf
*Attorney, Agent, or Firm*—Guy W. Shoup; Gerard F. Dunne

[57] ABSTRACT

A miniaturized locking type push-button switch capable of being assembled easily, and consisting of an operating unit, a spring urging the operating unit in a direction opposite to the direction in which the operating unit is pressed, a slide element holding movable contact members therein, having a heart-shaped groove and slidingly moved in accordance with the displacement of the operating unit on a member to which fixed contact members are attached, a single-acting pin moving along the heart-shaped groove in accordance with an amount of displacement of the operating unit, and an enclosure in which the above parts are housed. This push-button switch is characterized by a single-acting pin supporting element consisting of a one-piece resilient plate having an inwardly extending tongue in the central portion thereof. The single-acting pin is oscillatably supported on the supporting element to form a single-acting block, which is inserted in the enclosure to be fixed therein. The single-acting pin supporting element can be held by fingers during the assembling of a locking mechanism for the switch, so that a push-button switch assembled excellently with ease even when the dimensions thereof have been much reduced.

4 Claims, 18 Drawing Figures

LOCKING TYPE PUSH-BUTTON SWITCH

BACKGROUND OF THE INVENTION

1. Field of the Invention

This invention relates to a locking type push-button switch and, more particularly, to a miniaturized locking type push-button switch which can be assembled easily.

2. Description of the Prior Art

There is a known locking mechanism, which has a heart-shaped groove and a single-acting pin, for a locking type push-button switch in which an operating unit can be locked in a fully pressed state. Such a locking type push-button switch consists of an operating unit, a spring urging the operating unit in a direction opposite to the direction in which the operating unit is normally pressed, a slide element holding a movable contact member therein and adapted to be slidingly moved on a substrate provided with fixed contact members, a single-acting pin, which consists of a wire rod bent at both end portions thereof, and which is adapted to be moved along a heart-shaped groove provided in the operating unit with one end of the single-acting pin slidably engaged with the heart-shaped groove, and an enclosure in which the above-mentioned elements are housed. The operating unit is locked in a fully pressed state by the movement of the single-acting pin along the heart-shaped groove.

FIGS. 1–8 illustrate a conventional push-button switch having an operating unit capable of being locked in a fully pressed state by the movement of such a single-acting pin along a heart-shaped groove. Among these drawings, FIGS. 1–4 are sectional views illustrating various stages of operation of the push-button switch arranged generally vertically, wherein FIG. 1 shows the push-button switch in a non-pressed state; FIG. 2 an operational stage in which the operating unit is in an intermediately pressed position; FIG. 3 an operational stage in which the operating unit is in a fully pressed position; and FIG. 4 an operational stage in which the operating unit is released from a pressing force after it has been pressed to a full extent. FIGS. 5–8 illustrate the relation between the heart-shaped groove and the single-acting pin with respect to various operational positions of the operating unit shown in FIGS. 1–4, wherein FIG. 5 shows the positional relation between the groove and pin with the operating unit in a non-pressed state; FIG. 6 the positional relation between the mentioned two with the operating unit in an intermediately pressed position; FIG. 7 the positional relation between the mentioned two with the operating unit in a fully pressed position; and FIG. 8 the positional relation between the mention two with the operating unit released from a pressing force after it has been pressed to a full extent.

When an operating unit 21 is in a non-pressed state or a preparative state, a cylindrical projection 25*b*″ of a slide element 25 is in a lower end portion of a bore 21*d* provided in the operating unit 21 (refer to FIG. 1), and a lower bent portion 30*b* is of a single-acting pin 30 at a point 21*e*′ of stability in a lower end portion of a heart-shaped groove 21*e* (refer to FIG. 5). In this preparative stage, fixed contact members 28′, 28″ are connected together electrically through a movable contact member 26.

When the operating unit 21 is then pressed at a head portion 21*a* thereof, a main portion 21*c* of the operating unit 21 is moved in the direction of the arrow A against the force of a spring 22 secured to a flange portion 21*b* thereof. Consequently, the cylindrical projection 25*b*″ of the slide member 25 enters an inclined portion 21*d*′ of the bore 21*d* formed in the main portion 21*c* of the operating unit 21, to be moved therein gradually in the upward direction as seen in FIGS. 1–3. As a result, a pressing force is applied clockwise to an arm portion 25*b*′ of the slide element 25, so that a slide block 25*a* is oscillated clockwise about a shaft 25*d*. In accordance with the oscillatory movement of the slide block 25*a*, the movable contact member 26 loosely fitted in a recess 25*c* formed in the slide element begins to be moved slidingly to the left on an insulating board 27 (refer to FIG. 2). In the meantime, the lower bent portion 30*b* of the single-acting pin enters a right-hand portion of the heart-shaped groove 21*e* as the operating unit 21 is downwardly displaced, to be moved round counterclockwise along the right-hand portion of the groove 21*e* in accordance with an amount of downward displacement of the operating unit (refer to FIG. 6).

When the operating unit 21 has been pressed to a full extent, the cylindrical projection 25*b*″ reaches the uppermost portion of the bore 21*d*, and the slide block 25*a* is oscillated leftward to a full extent. Accordingly, the movable contact member 26 reaches an extreme left position, so that fixed contact members 28, 28′ are connected together electrically via the movable contact member 26 to allow the electric circuit to be shifted (refer to FIG. 3). At this time, the lower bent portion 20*b* of the single-acting pin 30 reaches the upper end of the right-hand portion of the heart-shaped groove (refer to FIG. 7).

When the operating unit 21 is then released from the pressing force, a returning force is applied thereto via the spring 22 to allow the operating unit 21 to be upwardly moved. At this time, the lower bent portion 30*b* of the single-acting pin 30 falls in an upper end portion 21*e*′ of the heart-shaped groove 21*e*. Consequently, the operating unit 21 cannot be moved upwardly any more and is locked in the position shown in FIGS. 4 and 8 as the operating unit 21 is urged upwardly by the spring 22. The electrical connection between the fixed contact members 28, 28′ is thus maintained even after the operating unit 21 has been released from the pressing force.

When the operating unit 21 is in the position shown in FIGS. 4 and 8 is pressed again, the lower bent portion 30*b* of the single-acting pin 30 is moved to the upper end of a left-hand portion of the heart-shaped groove 21*e*, so that the operating unit 21 is unlocked. When the operating unit 21 is then released from the pressing force, it begins to be moved upwardly by the force of the spring 22. Also, the cylindrical projection 25*b*″ is moved along the bore 21*d* in a direction opposite to the direction in which it was moved when the operating unit 21 was pressed for the first time, and the lower bent portion 30*b* of the single-acting pin 30 moves towards the lower point 21*e*′ of stability along the left-hand portion of the heart-shaped groove 21*e*. When the operating unit has been returned to the original position, it is in such a state as shown in FIGS. 1 and 5, and the electrical connection between the fixed contact members is also returned to the original condition.

Referring to the drawings, reference numeral 23 denotes an enclosure, and 24 a plate spring adapted to urge the single-acting pin 30 in such a manner that the lower bent portion 30*b* of the single-acting pin 30 is engaged constantly with the heart-shaped groove 21*e*.

The above-described push-button switch permits the operating unit therein to be locked in a pressed state, and the dimensions thereof can be reduced to a great extent. However, it is necessary that the single-acting pin 30 and plate spring 24 be installed together in the enclosure 23. This makes it troublesome to assemble the push-button switch. Especially in the case of a miniaturized switch, the enclosure 23 is too small to allow a finger to be inserted thereinto, and it is very difficult to carry out an assembling work therefor. This could cause a badly assembled switch to be produced, and such a switch could be erroneously operated.

FIG. 9 is a perspective view of another type of conventional push-button switch, in which an operating unit is locked by the movement of a single-acting pin along a heart-shaped groove. In this drawing, the parts of the push-button switch which are equivalent to those of the push-button switch shown in FIG. 1, are designated by the same reference numerals, and detailed descriptions thereof will be omitted. The push-button switch shown in FIG. 9 is not provided with a spring (correspondingly to the spring 22 shown in FIG. 1) for use in returning the operating unit.

Referring to the drawing, reference numeral 31 denotes a single-acting pin formed by bending both end portions of a wire material in the same direction, and 32 a single-acting pin mounting member secured to an insulating board 27 at right angles thereto. The mounting member 32 is provided with a bore 32*a* for inserting one end portion 31*a* of the single-acting pin 31 thereinto, and a clearance hole 32*b* for inserting the other end portion 31*b* of the single-acting pin 31 thereinto. Thus, when the end portions 31*a*, 31*b* of the single-acting pin 31 are inserted into the bore 32*a* and clearance hole 32*b*, respectively, the single-acting pin 31 can be oscillated about the end portion 31*a* along the clearance hole 32*b*. The end portion 31*b* of the single-acting pin 31 is engaged via the clearance hole 32*b* with a heart-shaped groove formed in a main portion 21*c* of an operating unit 21. Reference numeral 33 denotes a plate spring attached to the single-acting pin mounting member 32. The plate spring 33 is adapted to urge constantly a projected portion 33*a* at the end portion 31*b* of the single-acting pin 31 so as to bring the end portion 31*b* into engagement with the heart-shaped groove (not shown).

The operation of this push-button switch is substantially the same as that of the push-button switch shown in FIGS. 1–8. The differences between the push-button switch shown in FIG. 9 and that shown in FIGS. 1–8 reside in only the arrangement and construction of the single-acting pin 31 and plate spring 33 in the former push-button switch. In the push-button switch shown in FIG. 9, the single-acting pin 31 and plate spring 33 are provided outside of an enclosure thereof unlike the single-acting pin and plate spring in the push-button switch shown in FIG. 1.

Consequently, no other parts can be provided within a space in which the single-acting pin 31 is moved in accordance with the displacement of the operating unit 21. This substantially hampers the miniaturization of the push-button switch. Moreover, such a single-acting pin easily contacts other parts to be often prevented from being operated properly.

SUMMARY OF THE INVENTION

Therefore, an object of the present invention is to provide a miniaturized, locking type push-button switch which can be easily assembled.

To this end, the present invention provides a locking type push-button switch having an operating unit, a spring urging the operating unit in a direction opposite to the direction in which the operating unit is pressed, a slide element holding movable contact members and, provided with a heart-shaped groove. The slide element is adapted to be moved slidingly in accordance with the displacement of the operating unit on a member to which fixed contact members are attached and, a single-acting pin formed by bending both end portions of a wire material and, engaged at one end portion thereof with the heart-shaped groove to be moved along the heart-shaped groove in accordance with an amount of displacement of the operating unit. An enclosure in which the mentioned parts are housed is also provided and the invention is characterized in that the push-button switch includes a supporting element for the single-acting pin which consists of a one-piece resilient spring plate having a tongue extending inwardly. The supporting element holds the other end portion of the single-acting pin so as to allow the single-acting pin to be oscillated freely with the first-mentioned end portion of the single-acting pin being engaged with the tongue. The supporting element can be inserted into the enclosure from an opening thereof quite easily to simplify assembly.

The above and other objects as well as advantageous features of the invention will become apparent from the following description of the preferred embodiments taken in conjunction with the accompanying drawings.

BRIEF DESCRIPTION OF THE DRAWINGS

FIGS. 1–4 are sectional views illustrating various stages of operation of the push-button switch, wherein: FIG. 1 shows the push-button switch in a non-pressed state; FIG. 2 shows an operational stage in which the operating unit is in an intermediately pressed position; FIG. 3 shows an operational stage in which the operating unit is in a fully pressed position; and FIG. 4 shows an operational stage in which the operating unit is released from a pressing force after it has been pressed to a full extent.

FIGS. 5–8 illustrate the relation between the heart-shaped groove and the single-acting pin with respect to various operational positions of the operating unit, wherein: FIG. 5 shows the positional relation between the groove and pin with the operating unit in a non-pressed state; FIG. 6 shows the positional relation between the mentioned two with the operating unit in an intermediately pressed position; FIG. 7 shows the positional relation between the mentioned two with the operating unit in a fully pressed position; and FIG. 8 shows the positional relation between the mentioned two with the operating unit released from a pressing force after it has been pressed to a full extent.

FIG. 11 is a perspective view illustrating the procedure of assembling the parts shown in FIG. 10 where

DESCRIPTION OF THE PREFERRED EMBODIMENTS

Embodiments of the present invention will be described with reference to the accompanying drawings.

Figure 1:
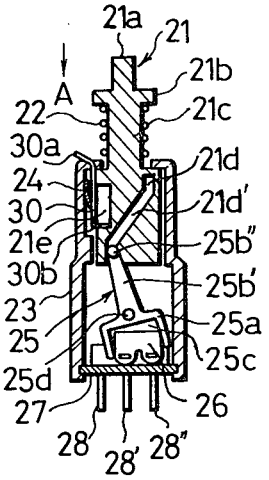
Fig. 1 PRIOR ART
FIGS. 1–8 illustrate a conventional push-button switch having an operating unit capable of being locked in a fully pressed state by the movement of a single-acting pin along a heart-shaped groove.
Figure 2:
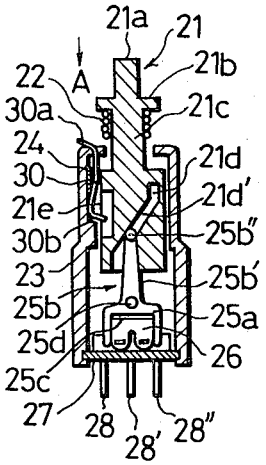
Fig. 2 PRIOR ART
Figure 3:
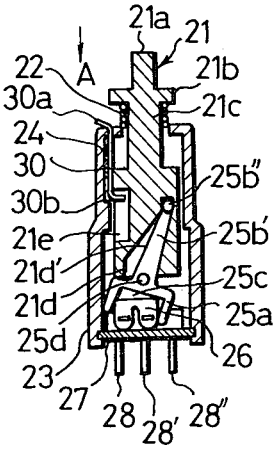
Fig. 3 PRIOR ART
Figure 4:
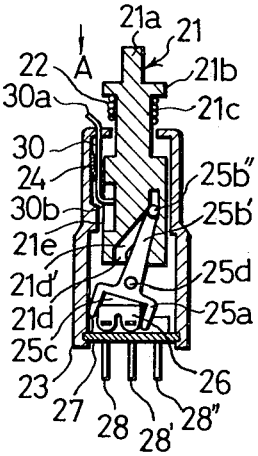
Fig. 4 PRIOR ART
Figure 5:
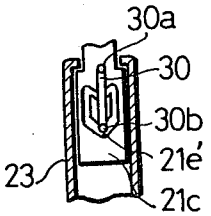
Fig. 5 PRIOR ART
Figure 6:
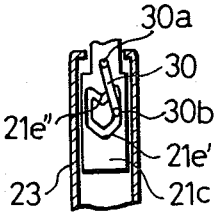
Fig. 6 PRIOR ART
Figure 7:
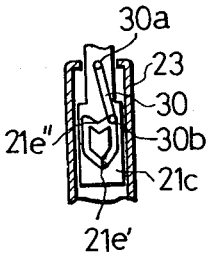
Fig. 7 PRIOR ART
Figure 8:
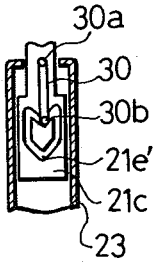
Fig. 8 PRIOR ART
Figure 9:
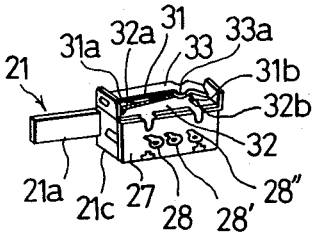
Fig. 9 PRIOR ART
FIG. 9 is a perspective view of another type of conventional push-button switch having an operating unit capable of being locked in a fully pressed state by the movement of a single-acting pin along the heart-shaped groove.
Figure 10:
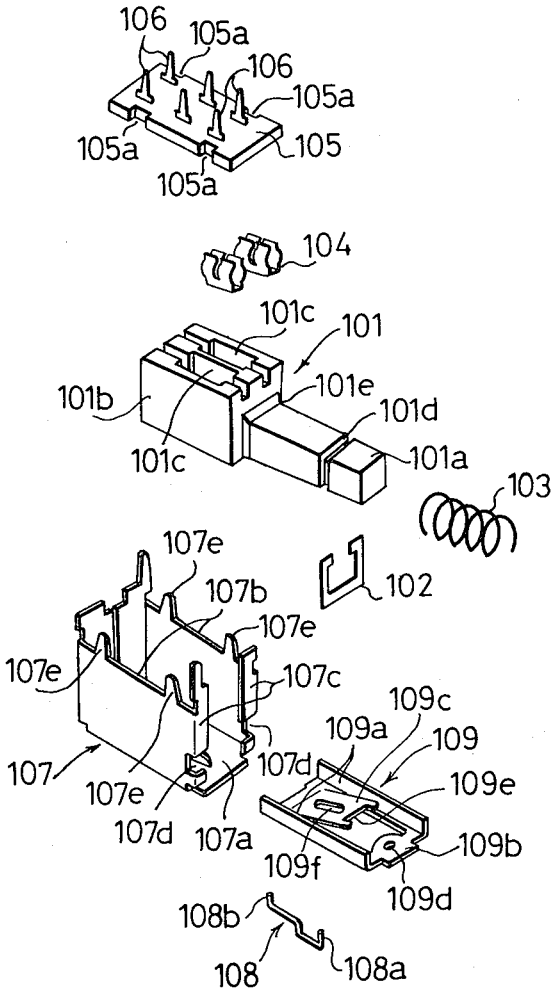
FIG. 10 is an exploded view of a locking type push-button switch according to the present invention.

FIG. 10 is an exploded view of a locking type push-button switch according to the present invention, and FIG. 11 a perspective view illustrating the assembly of the push-button switch shown in FIG. 10.

Referring to the drawings, reference numeral 101 denotes an operating unit having an operating portion 101*a*, and a slide block 101*b* provided with a heart-shaped groove in the lower surface thereof. The slide block 101*b* is also provided with recesses 101*c* and 101*c* in the upper surface thereof in which movable contact members, which will be described later, are to be loosely fitted. The operating portion 101*a* is provided with a groove 101*d* for receiving a flange 102 and a spring 103 is inserted between the flange 102 and an inclined portion 101*e* of the operating unit 101 so as to urge the operating unit 101 in a direction opposite to the direction in which it is normally pressed. Movable contact members 104 are loosely fitted in the recesses 101*c* and 101*c* in the slide block 101*b*, and an insulating board 105 having recesses 105*a* at the four portions thereof carries fixed contact members 106 planted therein. A box-type enclosure 107 is adapted to house the above mentioned element. The enclosure 107 is opened at two adjacent sides thereof, and the opening is defined by a base plate 107*a* and two side walls 107*b*. The side walls 107*b* are extended outwardly, and these extended portions are bent inwardly at right angles to form the two bent flanges 107*c*, which serve to prevent the slide block 101*b* from falling from the front opening. Recesses 107*d* are provided at lower end portions of the bent flanges 107*c*. The two side walls 107*b* are provided at end portions thereof with four projections 107*e* engageable with the recesses 105*a* provided in the insulating board 105. Reference numeral 108 denotes a single-acting pin, which constitutes together with a heart-shaped groove (not shown) formed in the slide block 101*b* a locking mechanism for the operating unit 101. The single-acting pin 108 has a stepped portion at an intermediate portion thereof, and is bent at both end portions 108*a* and 108*b* in the same directions. Reference numeral 109 denotes a supporting element for the single-acting pin, which is formed by processing a resilient spring plate. The supporting element 109 has and having a substantially C-shaped cross section or is bent like a letter "C" in section to form the two ears 109*a* at respective side portions thereof. The supporting element 109 is also provided with a tongue 109*c* substantially in the central portion of a bottom wall 109*b* thereof. The tongue 109*c* is formed by cutting the central portion of the bottom wall 109*b* and then bending the cut portion inwardly. The bottom wall 109*b* is further provided with a hole 109*d* with which one end portion 108*a* of the single-acting pin 108 is to be engaged. The tongue 109*c* is provided with a recess 109*e* at a front end portion thereof, and an opening 109*f* in the central portion thereof.

The procedure of assembling the locking type push-button switch according to the present invention will now be described.

Figure 11A:
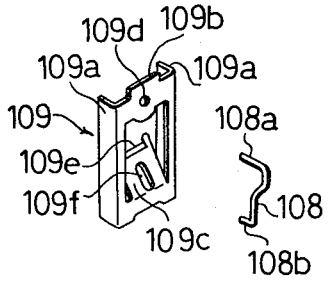
FIG. 11*a* is the single-acting pin brought into engagement with the hole in the bottom wall of the supporting element.

First, one end portion 108*a* of the single-acting pin 108 is brought into engagement with the hole 109*d* in the bottom wall 109*b* of the supporting element 109 from the rear side thereof (refer to FIG. 11*a*).

Figure 11B:
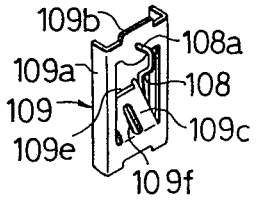
FIG. 11*b* shows the single-acting pin being brought into engagement with the recess at the front of the resilient tongue.
Figure 11C:
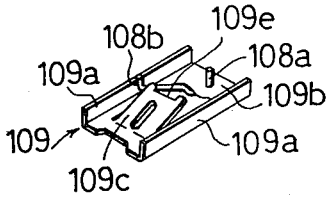
FIG. 11*c* shows the single-acting pin as it is being passed around the tongue.
Figure 11D:
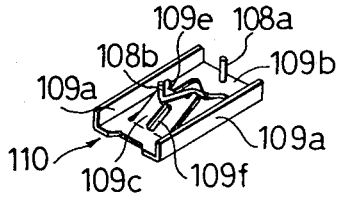
FIG. 11*d* shows the single-acting block formed by combining the single-acting pin and the supporting element.
Figure 11E:
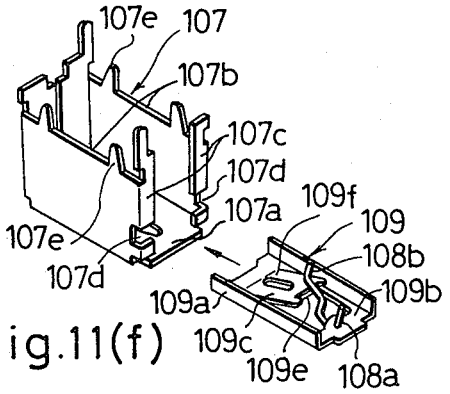
FIG. 11*e* shows the alignment of the single-acting block and the enclosure prior to insertion.
Figure 11F:
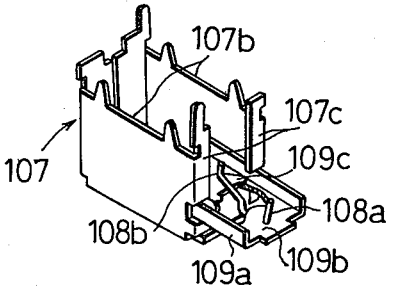
FIG. 11*f* shows the single-acting block partially inserted into the enclosure.
Figure 11G:
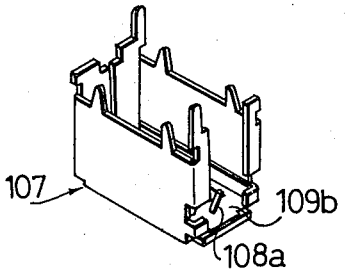
FIG. 11*g* shows the single-acting block in its final position in the enclosure.

The other end portion 108*b* of the single-acting pin 108 is then brought into engagement with the recess 109*e* at the front end of the resilient tongue 109*c* in such a manner as shown in FIGS. 11*b*–11*d*, i.e., by being passed around the tongue 109*c*. As a result, a single-acting block 110 (refer to FIG. 11*d*), in which the single-acting pin 108 and the single-acting pin supporting element 109 are combined together, is formed.

The single-acting block 110 is then inserted (refer to FIGS. 11*e* and 11*f*) into the enclosure 107 in such a manner that the ears, 109*a* are fitted into the receses 107*d* provided in the bent flanges 107*c*. After the single-acting block 110 has been fully inserted into the enclosure 107, the former is pressed from above to lower the same. Consequently, the single-acting block 110 is lowered to the rear wall of the enclosure 107 to be engaged therewith, and the ears 109*a* come into engagement with the bent flanges 107*c* so that the single-acting block 110 does not fall frontwardly (refer to FIG. 11*g*).

The slide block 101*b* is then inserted into the enclosure 107 from above in such a manner that the heart-shaped groove formed in the rear surface of the slide block 101*b* comes into engagement with the end portion 108*b* of the single-acting pin 108. The movable contact members 104 are then loosely fitted in the recesses 101*c* formed in the slide block 101*b*. Finally, the projections 107*e* of the enclosure 107 are brought into engagement with the recesses 105*a* in the insulating board 105, and the projections 107*e* are bent to fix the insulating board 105 to the enclosure 107. Thus, the locking type push-button switch according to the present invention is assembled completely.

Figure 12:
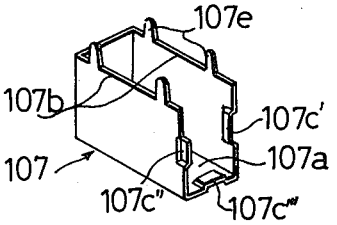
FIG. 12 is a perspective view of another example of an enclosure, which can be employed in the present invention.

The enclosure 107 may be substituted by an enclosure 107 shown in FIG. 12. In this enclosure, side walls 107*b*, and a base plate 107*a* are provided with projections 107*c*', 107*c*'', 107*c*''' instead of the bent flanges 107*c* provided in the enclosure shown in FIGS. 10 and 11. The projections 107*c*', 107*c*'' serve to prevent the slide block 101*b* from falling frontwardly, and the projection 107*c*''' serves to prevent the single-acting block from falling frontwardly.

According to the present invention described above, a single-acting pin supporting element can always be held by the fingers of an assembler during the assembling of a locking mechanism for a miniaturized push-button switch. Accordingly, a push-button switch can be assembled very easily even when the dimensions thereof have been much reduced. In fact, the push-button switch according to the present invention is assembled excellently, so that it is not erroneously operated. The present invention permits providing a miniaturized, low-priced locking type push-button switch having a stable quality.

The locking type push button switch according to the present invention has solved the problem that the difficulty in assembly a push-button switch increases as the dimensions thereof are reduced, and can be used as a subminiature, locking mechanism-containing push-button switch.

The present invention is not, of course, limited to the above embodiments; it may be modified in various ways within the scope of the appended claims.

What is claimed is:

1. In a locking type push-button switch having an operating unit, a spring urging said operating unit in a direction opposite to the direction in which said operating unit is actuatable, a slide element holding movable contact members therein and provided with a heart-shaped groove, said slide member being adapted to be moved slidingly in accordance with the displacement of said operating unit on a member to which fixed contact members are attached, a single-acting pin engaged at one end portion thereof with said heart shaped groove and adapted to be moved along said heart-shaped groove in accordance with an amount of displacement of said operating unit, and an enclosure in which the mentioned parts are housed, the improvement wherein said push-button switch includes an element for supporting said single-acting pin and consisting of a one-piece resilient spring plate having a tongue extending inwardly said supporting element holding the other end portion of said single-acting pin so as to allow said single-acting pin to be oscillated freely with the first-mentioned end portion of said single-acting pin being engaged with said tongue, said supporting element being inserted into said enclosure from an opening thereof to be fixed therein.

2. A switch according to claim 1, said supporting element having ears formed at opposing side portions thereof, said enclosure having an opening adapted to receive said supporting element, and means formed about said opening for engaging said ears once said supporting member is urged into position.

3. A switch according to claim 2, said means including flanges extending inwardly from opposing side walls of said opening and having opposing recesses adapted to receive said ears.

4. A switch according to claim 2, said means including indented portions along said opening for engaging said ears.

* * * * *